United States Patent [19]

Satake

[11] Patent Number: 4,722,446

[45] Date of Patent: Feb. 2, 1988

[54] VIBRATORY GRAIN SORTING MACHINE

[75] Inventor: Toshihiko Satake, Hagashihiroshima, Japan

[73] Assignee: Satake Engineering Co., Ltd., Tokyo, Japan

[21] Appl. No.: 709,451

[22] Filed: Mar. 8, 1985

[30] Foreign Application Priority Data

Apr. 27, 1984 [JP] Japan ..... 59-87254
May 8, 1984 [JP] Japan ..... 59-92474

[51] Int. Cl.[4] ..... B07C 9/00; B07B 13/10

[52] U.S. Cl. ..... 209/694; 209/480; 209/504

[58] Field of Search ..... 209/691, 694, 479–481, 209/503, 504, 508

[56] References Cited

U.S. PATENT DOCUMENTS 1,686,374 10/1928 Franks ..... 209/480
1,696,918 1/1929 Lide ..... 209/508
2,788,897 4/1957 Snyder ..... 209/694
4,251,358 2/1981 Mozley ..... 209/504 X

FOREIGN PATENT DOCUMENTS 1241242 5/1967 Fed. Rep. of Germany ..... 209/694
51-114251 10/1976 Japan .
55-11391 3/1980 Japan .
56-144781 11/1981 Japan .
56-144782 11/1981 Japan .
1012436 12/1965 United Kingdom ..... 209/694

*Primary Examiner*—Robert B. Reeves
*Assistant Examiner*—Edward M. Wacyra
*Attorney, Agent, or Firm*—Henry Sternberg; Bert J. Lewen

[57] ABSTRACT

Disclosed is a vibratory grain sorting machine which comprises an assembly to be vibrated at least including a frame and at least one stack of sorting plate members. The assembly to be vibrated is pivotally supported on a base structure by a plurality of strut units. At least one of the strut units has a top end pivotally connected to a side wall of the frame and a bottom end pivotally connected to the base structure. Each of the remaining strut units has a top end pivotally connected to a bottom wall of the frame and a bottom end pivotally connected to the base structure. A vibrating device is connected to the frame to apply a force substantially toward and away from the center of gravity of the assembly to be vibrated, thereby angularly reciprocating the assembly to be vibrated, around the bottom ends of the respective strut units.

30 Claims, 6 Drawing Figures

VIBRATORY GRAIN SORTING MACHINE

BACKGROUND OF THE INVENTION

1. Field of the Invention

The present invention relates to a vibratory grain sorting machine.

2. Description of the Prior Art

A generally known vibratory grain sorting machine comprises a frame having fixedly mounted thereon a stack of sorting plate members. An assembly to be vibrated including at least the frame and the stack o sorting plate members fixedly mounted thereon is inclined with respect to the horizontal plane so that a bottom wall of the frame has an upper edge and a lower edge. The assembly to be vibrated is supported on a base structure by four strut units. A first pair of strut units are spaced from each other along the lower edge of the bottom wall of the frame and have respective top ends pivotally connected to the bottom wall of the frame adjacent to the lower edge thereof and respective bottom ends pivotally connected to the base structure. A second pair of strut units ar spaced from each other along the upper edge of the bottom wall of the frame and have respective top ends pivotally connected to the bottom wall of the frame adjacent to the upper edge thereof and respective bottom ends pivotally connected to the base structure.

The thus constructed vibratory grain sorting machine is disclosed in Japanese Patent Laid-Open Nos. 56-144781 and 56-144782 filed in the name of Toshihiko Satake who is the same as the inventor of the present application and laid open to public inspection on Nov. 11, 1981. The disclosure in these Satake patent applications is incorporated as a reference into the present specification. In addition, reference should be made to Japanese Patent Laid-Open No. 51-114251 filed in the name of Toshihiko Satake who is the same inventor as the present inventor, and laid open to public inspection on Oct. 7, 1976 and Japanese Patent Publication No. 55-11391 filed in the nam of Toshihiko Satake who is the same inventor as the present inventor, and published for opposition purpose on Mar. 25, 1980. The sorting machine disclosed in the above-described Japanese Patent Laid-Open No. 51-114251 includes a frame having a bottom wall disposed horizontally.

In the conventional sorting machine comprising a frame having an upper edge and a lower edge and first and second pairs of strut units each of which has the top end pivotally connected to the bottom wall of the frame, the minimum height of the assembly to be vibrated, with respect to the base structure is determined by the longitudinal dimension of the first pair of strut units. This would inveitably result in the increase in height of the assembly to be vibrated, with respect to the base structure and would result in the reduction in stability of the overall sorting machine.

In addition, it is not known to connect the vibrating device of the conventional sorting machine to the frame so as to apply a vibratory force to the assembly to be vibrated, toward and away from the gravitational center of such assembly. Consequently, there results a rotational moment around the gravitational center of the assembly to be vibrated. Such rotational moment causes an impact force to be applied to the respective pivotal connections between the frame and the top ends of the strut units and the respective pivotal connections between the base structure and the bottom ends of the strut units, resulting in the reduction in durability of these pivotal connections.

Moreover, the vibrating device of the conventional sorting machine is mounted on the base structure at a location below the frame. This makes it difficult for an operator to have accessibility to the vibrating device for the purpose of maintenance and inspection.

SUMMARY OF THE INVENTION

An object of the present invention is to provide a vibratory grain sorting machine in which an assembly to be vibrated is reduced in height with respect to the base structure to thereby enhance a stability of the overall sorting machine and a rotational moment applied to the assembly to be vibrated is minimized.

Another object of the invention is to provide the vibratory grain sorting machine in which a vibrating device is readily accessible for the purpose of maintenance and inspection.

According to the present invention, there is provided a vibratory grain sorting machine comprising: a frame having opposed side walls and a bottom wall extending therebetween; at least one stack of sorting plate members each of which has a roughened upper surface, the stack of sorting plate members fixedly mounted on said frame so that the roughened upper surfaces of the respective sorting plate members are spaced from each other, each of the sorting plate members being inclined in a three-dimensional manner with respect to a horizontal plane so as to have an upper side edge, a lower side edge, an upper end and a lower end for discharging grain, the respective upper side edges extending along one of the side walls of the frame and the respective lower side edges extending along the other side wall of the frame; a base structure; a plurality of strut units supporting, on the base structure, a assembly to be vibrated at least including the frame and the stack of sorting plate members fixedly mounted thereon so that the assembly to be vibrated is movable relative to the base structure and that a first intersecting line between the bottom wall and the one side wall of the frame is located above a second intersecting line between the bottom wall and the other side wall of the frame, at least one of the strut units having a top end pivotally connected to the other side wall of the frame at a location between upper and lower ends of the other wall and a bottom end pivotally connected to the base structure, and each of the remaining strut units having a top end pivotally connected to an area, adjacent to the first intersecting line, of the bottom wall of the frame and a bottom end pivotally connected to the base structure; supply means for supplying a mixture of a first kind of grain and a second kind of grain having a specific gravity different from that of the first kind of grain, onto the roughened upper surfaces of the respective sorting plate members at the upper ends of the respective sorting plate members, t thereby allow the mixture to flow toward the lower ends of the respective sorting plate members; vibrating means fixedly mounted relative to the base structure and connected to the frame for applying a force to the assembly to be vibrated, substantially toward and away from a center of gravity thereof, to angularly reciprocate the assembly to be vibrated, around the bottom ends of the respective strut units, to thereby enable a stream of the first kind of grain, a stream of the second kind of grain and a stream of mixture of the first and second kinds of grain to be separately formed on the roughened upper surface of each of the sorting plate members, while the supplied mixture is flowing toward the lower ends of the respective sorting plate members; and collecting means for separately collecting the stream of the first kind of grain, the stream of the second kind of grain and the stream of the mixture from the lower end of each of the sorting plate members.

DETAILED DESCRIPTION OF THE PREFERRED EMBODIMENTS

Figure 1:
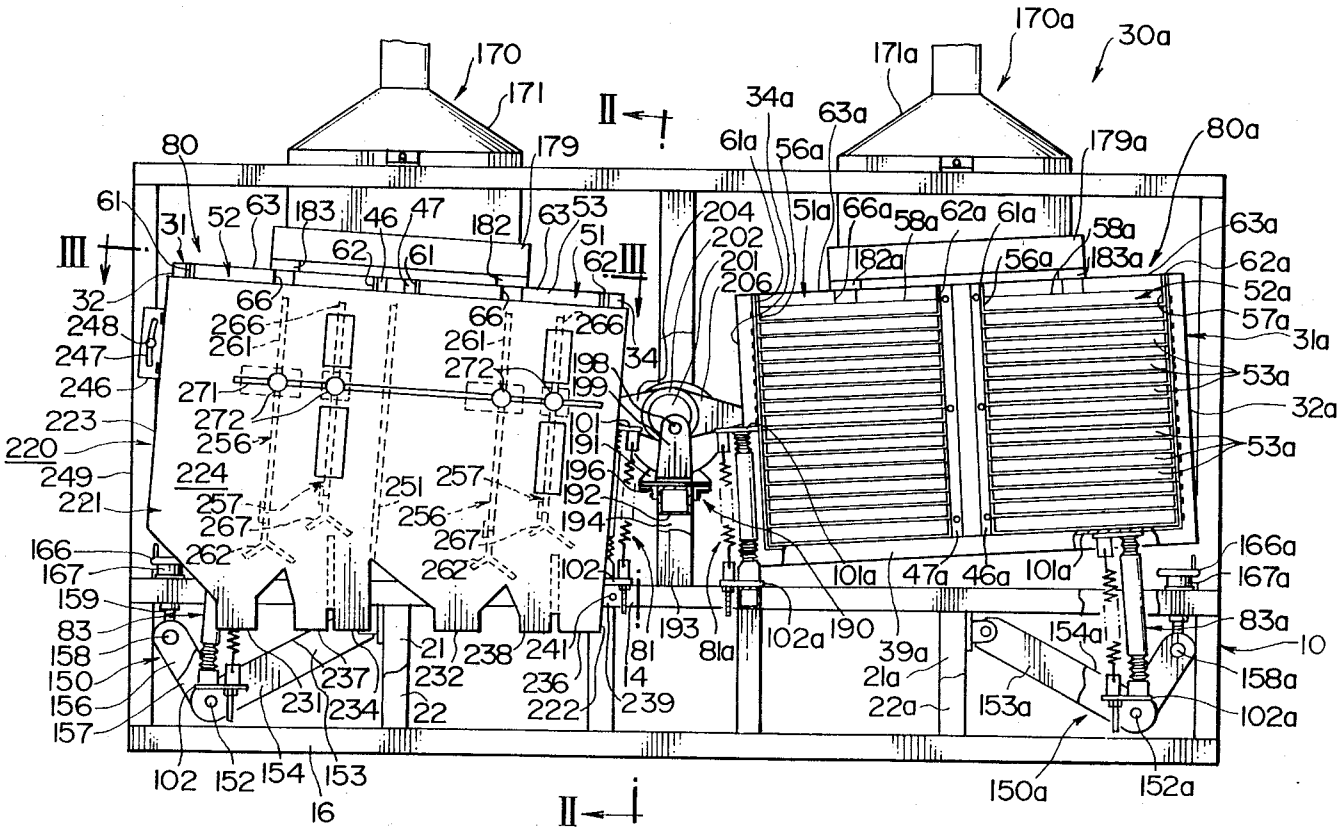
FIG. 1 is a front elevational view of a grain sorting machine in accordance with one embodiment of the invention, with a right side one of a pair of collecting assemblies for sorted grain being removed for showing stacks of sorting plate members.

Referring now to FIGS. 1 to 5, there is shown a vibratory grain sorting machine in accordance with an embodiment of the present invention. The sorting machine comprises a base structure generally designated by the reference numeral 10. The base structure 10 includes a plurality of horizontal top structural members 11, 13, 14, a plurality of horizontal bottom structural members 16, 17 and a plurality of vertical structural members 21, 22, 21*a*, 22*a*. These horizontal and vertical structural members are connected to each other by suitable means such as welding or bolts (not shown).

As best shown in FIG. 1, a pair of sorting units, generally designated by the reference numerals 30 and 30*a*, arranged in symmetrical relation with respect to the vertical plane and in spaced relation in the horizontal direction, are identical in structure with each other, and a detailed explanation will now be made only as to the left side sorting unit 30. The components of the right side sorting unit 30*a* corresponding to those of the left side sorting unit 30 are designated by the same reference numerals with a suffix a, and the description will be omitted as to the components of the right side sorting unit 30*a*.

Figure 2:
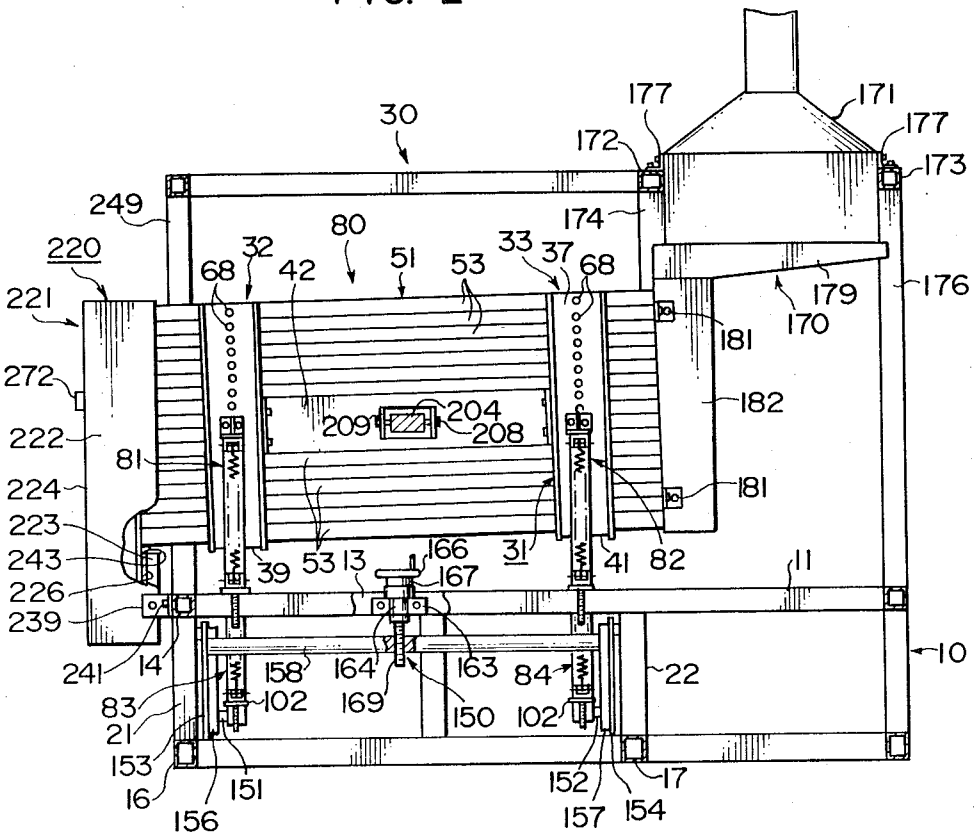
FIG. 2 is a cross-sectional view taken along the line II—II of FIG. 1.
Figure 3:
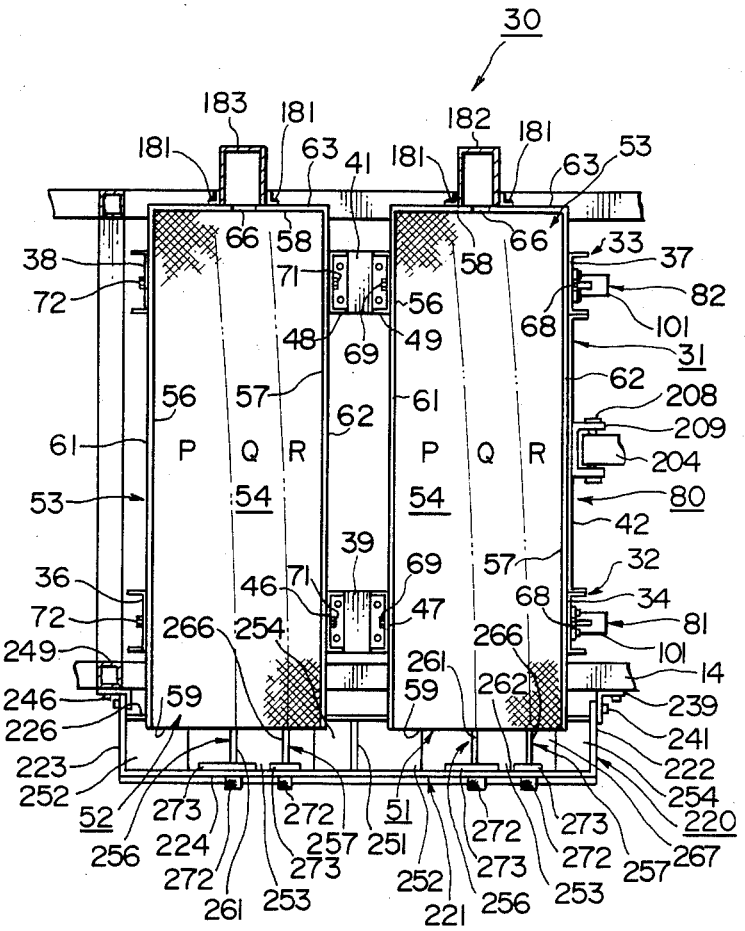
FIG. 3 is a cross-sectional view taken along the line III—III of FIG. 1.

As best shown in FIGS. 2 and 3, the sorting unit 30 includes a frame 31 which comprises U-shaped channel members 32 and 33 each of which, in turn, has opposed legs 34 and 36, 37 and 38 and a bottom 39, 41. The frame 31 further comprises a horizontal channel member 42 fastened by bolts to one legs 34 and 37 of the respective U-shaped channel members 32 and 33 to connect the legs to each other. As best shown in FIG. 3, fastened by bolts to the bottoms 39 and 41 of the respective U-shaped channel members 32 and 33 are a pair of opposed channel members 46 and 47 and a pair of opposed channel members 48 and 49, respectively. Thus, the legs 36 and 38 of the respective U-shaped channel members 32 and 33 constitute one of opposed side walls of the frame 31, the legs 34 and 37 of the respective U-shaped channel members 32 and 33 and the horizontal channel member 42 constitute the other side wall of the frame 31, and the bottoms 39 and 41 of the respective U-shaped channel members 32 and 33 constitute a bottom wall of the frame 31. In addition, the channel members 46 and 47, and 48 and 49 fastened, respectively, to the U-shaped channel members 32 and 33 form a third wall, i.e., a central wall.

Figure 4:
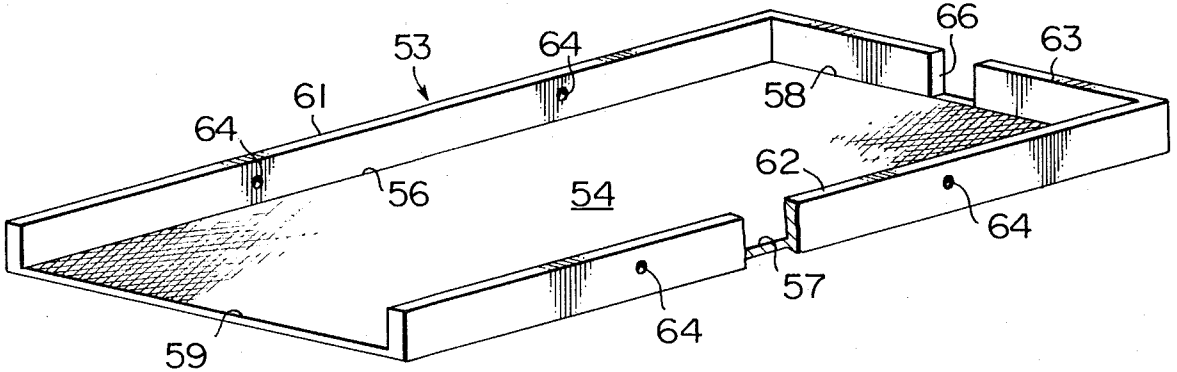
FIG. 4 is a perspective view showing one of the sorting plate members.

A pair of stacks of sorting plate members, generally designated by reference numerals 51 and 52, are fixedly mounted on the frame 31. As best shown in FIG. 4, each of the sorting plate members 53 has a rectangular roughened upper surface 54 which has parallel side edges 56 and 57 together with one end 58 and the other end 59 for discharging sorted grains. Each of the sorting plate members 53 includes an upstanding side wall 61 at the one side edge 56, an upstanding side wall 62 at the other side edge 57 and an end wall 63 at the one end 58. Each of the side walls 61 and 62 is provided with a pair of threaded bores 64 and the end wall 63 is provided with a cut-away portion 66 in the mid portion thereof for supplying the upper surface 54 with the grain mixture to be sorted. As shown in FIGS. 1 and 2, the stacks of sorting plate members 51 and 52 are fixedly mounted on the frame 31 so that the roughened upper surfaces 54 of the respective sorting plate members 53 are spaced from each other in parallel relation.

Each of the sorting plate members 53 of the stack 51 is inclined in a three-dimensional manner, so that the side edge 56 of each of the sorting plate members 53 is located above the side edge 57 thereof and the one end 58 is located above the other end 59. The lower edge 57 of each of the sorting plate members 53 of the stack 51 extends in parallel relation along the legs 34 and 37 of the respective U-shaped channel members 32 and 33, and the upper edge 56 extends in parallel relation along the channel members 47 and 49. More specifically, the upstanding wall 62 of each sorting plate member 53 is fastened to the legs 34 and 37 of the respective U-shaped channel members 32 and 33 by bolts or screws 68 threadedly engaging with the threaded bores 64 in the upstanding side wall 62, and the upstanding side wall 61 is fastened to the channel members 47 and 49 by bolts or screws 69 threadedly engaging with the threaded bores 64 in the upstanding side wall 61. Similarly, the sorting plate members 53 of the stack 52 are inclined in a three-dimensional manner, so that the side edge 56 of each sorting plate member 53 is located above the side edge 57 and the one end 58 is located above the other end 59. The lower edge 57 of each of the sorting plate members 53 of the stack 52 extends in parallel relation along the channel members 46 and 48, and the upper edge 56 extends in parallel relation along the legs 36 and 38 of the respective U-shaped channel members 32 and 33. More specifically, the upstanding side wall 62 of each sorting plate member 53 is fastened to the channel members 46 and 48 by bolts or screws 71 threadedly engaging with the threaded bores 64 in the upstanding side wall 62, and the upstanding side wall 61 is fastened to the respective legs 36 and 38 of the U-shaped channel members 32 and 33 by bolts or screws 72 threadedly engaging with the threaded bores 64 in the upstanding side wall 61.

An assembly to be vibrated, generally designated by the reference numeral 80, including at least the frame 31 and the pair of stacks of sorting plate members 51 and 52, is supported on the base structure 10 by a pair of inward strut units 81 and 82 and a pair of outward strut units 83 and 84 such that the assembly to be vibrated 80 is movable relative to the base structure 10 and that a intersecting line formed by the bottoms 39 and 41 and the legs 36 and 38 of the respective U-shaped channel members 32 and 33 is located above an intersecting line formed by the bottoms 39 and 41 and the legs 34 and 37. The pair of inward strut units 81 and 82 have their respective top ends pivotally connected to areas of the respective legs 34 and 37 of the U-shaped channel members 32 and 33, respectively, which areas are substantially centrally located in the heightwise direction of the respective legs 34 and 37, and respective bottom ends pivotally connected to the horizontal top structural member 11 of the base structure 10. The pair of outward strut units 83 and 84 have their respective top ends pivotally connected to areas, adjacent to the legs 36 and 38, of the respective bottoms 39 and 41 of the U-shaped channel members 32 and 33, respectively, and bottom ends disposed adjacent to the horizontal bottom structural members 16 and 17 of the base structure 10, respectively.

Figure 5:
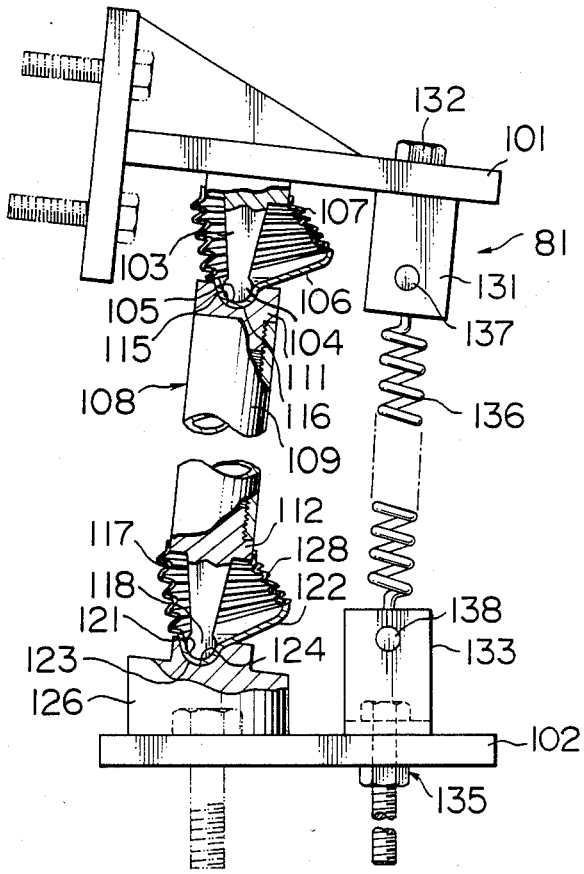
FIG. 5 is a partially broken-away, enlarged view showing a strut unit.

The strut units 81, 82, 83 and 84 are substantially identical in structure with each other, and only the strut unit 81 will be described with reference to FIG. 5. The strut unit 81 comprises an upper bracket 101 to be fastened to the frame 31 by fastening means such as bolts or screws shown by phantom lines and a lower bracket 102 to be fastened to the base structure 10 by fastening means such as bolts or screws shown by phantom lines. An upper projection 103 having an elongated, rounded free end 104 is secured to the upper bracket 101 by welding or the like, and extends from the bracket 101 toward the lower bracket 102. The rounded free end 104 is received in a complemental groove 105 formed in an oil retaining member 106. A lubricating oil is filled in the oil retaining member 106. A bellows 107 made of elatic material such as rubber has one end sealingly secured to a base of the projection 103 and a lower end sealingly secured to a periphery of the oil retaining member 106. A hollow cylindrical strut body 108 comprises a cylindrical member 109, a top head 111 threadedly engaging with a top end of the cylindrical member 109 and a bottom head 112 threadedly engaging with a bottom end of the cylindrical member 109. The top head 111 has an elongated groove 115 in complemental relation with a protuberance 116, defining the groove 105, on the oil retaining member 106. The bottom head 112 has a projection 117 which is integral therewith and extends toward the lower bracket 102. The projection 117 has an elongated rounded free end 118 similar to the free end 104. The free end 118 of the projection 117 is received in a groove 121 in an oil retaining member 122 similar to the groove 105 in the oil retaining member 106. A protuberance 123 on the oil retaining member 122 is received in a groove 124 complemental with the protuberance 123, formed in a bearing block 126 which is secured to the lower bracket 102 by welding or the like. A bellows 128 similar to the bellows 107 has an upper end sealingly secured to the bottom head 112 and a lower end sealingly secured to the bearing block 126. A U-shaped spring retainer 131 is fastened to the upper brackes 101 by a bolt 132. A U-shaped spring retainer 133 is fastened to the lower bracket 102 by a bolt and nut assembly 135. A coil spring 136 has an upper end thereof anchored to a pin 137 mounted on the retainer 131 and a lower end anchored to a pin 138 mounted on the retainer 133 and is arranged in tension so as to pull the upper bracket 101 and the lower bracket 102 toward each other. The rotation of the nut of the bolt and nut assembly 135 enables the tension of the spring 136 to be adjusted. For further detailes of the strut unit, reference should be made to the above-described Japanese Patent Laid-Open Nos. 56-144781 and 56-144782.

Referring back to FIGS. 1 and 2, an inclination adjusting mechanism, generally designated by the reference numeral 150, for adjusting an inclination of the assembly to be vibrated 80, with respect to the base structure 10 comprises pins 151 and 152 on which are fixedly mounted the lower brackets 102 and 102 of the respective strut units 83 and 84, respectively; first links 153 and 154 having their respective one ends to which the pins 151 and 152 are fixed, respectively and the respective other ends pivotally mounted on the vertical structural members 21 and 22 of the base structure 10, respectively; and second links 156 and 157 having their respective one ends pivotally connected to the pins 151 and 152, respectively and the respective other ends pivotally connected to a common rod 158. A threaded shaft 159 threadedly engaging with the common rod 158 extends through and is rotatably supported by a bearing block 164 fixed to the horizontal top structural member 13 by a bracket 163 (FIG. 2). An actuator wheel 166 is fixedly connected to an enlarged head 167 of the threaded shaft 159. The rotation of the actuator wheel 166 by an operator causes the threaded shaft 159 to be rotated. The rotation of the threaded shaft 159 causes the common rod 158 to be moved along the threaded shaft 159 dependent upon the direction of the rotation. The movement of the common rod 158 causes the second links 156 and 157 and the first links 153 and 154 pivotally connected thereto to be pivotally moved, thereby moving the pins 151 and 152. The movement of the pins 151 and 152 causes the struts units 83 and 84 to be moved, whereby the assembly to be vibrated 80 is pivotally moved relative to the base structure 10 around the bottom ends of the respective strut units 81 and 82. Thus, it is possible to adjust the inclination of the assembly to be vibrated 80, with respect to the base structure 10.

Referring to FIGS. 1 to 3, a grain supply structure, generally designated by the reference numeral 170, is adapted to supply the cut-away portion 66 in each sorting plate member 53 of the stacks 51 and 52 with a mixture of a first kind of grain such as, for example, brown rice and a second kind of grain such as, for example, paddy which is lower in specific gravity than that of the brown rice, to allow the mixture to flow toward the other lower ends 59 of the respective sorting plate members 53. As best shown in FIG. 2, the grain supply structure 170 comprises a supply duct assembly 171 fixed by L-shaped brackets 177 to horizontal structural members 172 and 173 connected to the base structure 10 by means of vertical structural members 174 and 176, and a grain distributing duct assembly 179 communicating with the supply duct assembly 171 and fixed by L-shaped brackets 181 to the one ends 58 of the respective sorting plate members 53. The grain distributing duct assembly 179 fixed to the sorting plate members 53 is movable relative to the supply duct assembly 171 fixed relative to the base structure 10. The grain distributing duct assembly 179 includes a pair of ducts 182 and 183 communicating with the cut-away portions 66 formed in the end walls 63 of the respective sorting plate members 53 of the stacks 51 and 52, respectively. The ducts 182 and 183 are shown in a schematic manner in the drawings, but actually have more complicated structures. However, such complicated ducts are well known in the art. As is apparent from the foregoing description, the aforesaid assembly to be vibrated 80 includes also the grain distributing duct assembly 179.

A vibrating device generally designated by the reference numeral 190 is disposed between the pair of assemblies to be vibrated 80 and 80*a*. The vibrating device 190 comprises an electric motor 191 fixedly mounted by means of a pair of brackets 196 to a horizontal structural member 192 interconnecting a pair of vertical structural members 193 and 19 fixedly connected to the base structure 10. The electric motor 191 has an output shaft 198 having a free end thereof rotatably supported by a bearing 199. An eccentric wheel 201 is mounted on the output shaft 198 for rotation therewith. A ring 202 is mounted around the eccentric wheel 201 so as to be rotatable relative thereto. A pair of connecting rods 204 and 206 are integrally connected to the ring 202 and extend therefrom in the directions opposite to each other. The pair of connecting rods 204 and 206 extend substantially in a horizontal plane including the gravitational centers of the respective assemblies to be vibrated 80 and 80*a* which are preferably substantially identical in weight with each other. As clearly shown in FIGS. 2 and 3, a free end of the connecting rod 204 is pivotally connected to a pin 208 supported by a U-shaped bracket 209 fixed to the horizontal channel member 42 of the frame 31 by welding or the like. When the motor 191 is energized, the eccentric wheel 201 is rotated around an axis of the output shaft 198 of the motor 191 to cause the connecting rod 204 to apply a force to the assembly to be vibrated 80, substantially toward and away from the gravitational center of the assembly to be vibrated 80, to thereby angularly reciprocate the assembly to be vibrated 80, around the bottom ends of the respective strut units 81, 82, 83 and 84. As a result, as shown in FIG. 3, the mixture which has been supplied through the cut-away portion 66 in the end wall 63 of each sorting plate member 53 flows toward the other end or lower end 59 thereof. In the meantime, a stream P of the first kind of grain, a stream R of the second kind of grain having a lower specific gravity than that of the first kind of grain and a stream Q of the mixture of the first and second kinds of grain are formed on the roughened upper surface 54 of each sorting plate member 53. Upon determining the gravitational center of the assembly to be vibrated 80, the weight of the grain within the grain supply structure 170 and the weight of the grain on each sorting plate member 53 should also be taken into consideration.

A collecting assembly, generally designated by the reference numeral 220, is adapted to collect the stream P of the first kind of grain, the stream R of the second kind of grain and the stream Q of the mixture from the lower end 59 of each of the respective sorting plate members 53 of the stacks 51 and 52. The collecting assembly 220 comprises a tubular body 221 having opposed side walls 222 and 223 and opposed front and rear walls 224 and 226. In addition, the tubular body 221 is provided at its bottom with discharge ports 231 and 232 for the first kind of sorted grain, discharge ports 234 and 236 for the second kind of sorted grain, and discharge ports 237 and 238 for the mixture. An L-shaped bracket 239 is fixed to the side wall 222 by a bolt and is pivotally mounted on the horizontal top structural member 14 of the base structure 10 by a pin 241, so that the tubular body 221 is pivotable relative to the base structure 10 around the pin 241. The rear wall 226 has a height lower than that of the front wall 224 to define, at the top end of the rear wall 226, an opening 243 (FIG. 2) for receiving the lower ends 59 of the respective sorting plate members 53. An L-shaped member 246 is fastened to an inner surface of the side well 223 of the tubular body 221 by bolts and is provided with an arcuate slot 247 (FIG. 1). A locking screw 248 is threadedly engaged through the slot 247 with a vertical structural member 249, to thereby constitute means for fixing the tubular body 221 relative to the base structure 10 at a desired angular position. A partition wall 251 divides a space within the tubular body 221 into a pair of chambers for the respective stacks of sorting plate members 51 and 52. Each chamber is further divided into first, second and third passages 252, 253 and 254 which are in communication with the discharge ports 231, 232; 234, 236; and 237, 238, respeftively. As best shown in FIGS. 1 and 3, a first partition member 256 associated with each stack 51, 52 for parting the stream P of the first kind of grain from the stream Q of the mixture discharged out of the lower end 59 of each sorting plate member 53 includes an elongated plate 261 and a bifurcated guide member 262 fixed to a bottom end of the elongated plate 261. Similarly, a second partition member 257 associated with each stack 51, 52 for parting the steam R of the second kind of grain from the stream Q of mixture discharged out of the lower end 59 of each sorting plate member 53 includes an elongated plate 266 and a bifurcated guide member 267 fixed to a bottom end of the elongated plate 266. As shown in FIG. 1, the tubular body 221 is provided with a slot 271. A locking screw 272 is threadedly engaged through the slot 271 with a closing strip 273 which is fixed to the elongated plate 261, 266 of each partition member 256, 257. Thus, the loosening of the locking screw 272 enables the associated partition member 256, 257 to be moved along the slot 271, and the tightening of the locking screw 272 enables the associated partition member 256, 257 to be locked at a desired position.

In operation, if necessary, the operator rotates the actuator wheel 166 of the inclination adjusting mechanism 150 to adjust the inclination of the assembly to be vibrated 80, with respect to the base structure 10. Subsequently, the operator loosens the locking screw 248 of the collecting assembly 220 to allow the collecting assembly 220 to be pivotally moved around the pin 241 so as to be into conformance with the inclination of the assembly to be vibrated 80. Then, the locking screw 248 is tightened to lock the collecting assembly 220 relative to the base structure 10 in a position. Subsequently, the operator energizes the motor 191 of the vibrating device 190 to cause the connecting rod 204 to apply a force to the assembly to be vibrated 80, substantially toward and away from the gravitational center thereof, to thereby angularly reciprocate the assembly to be vibrated 80 relative to the base structure 10 around the bottom ends of the respective strut units 81, 82, 83 and 84. The mixture of the first and second kinds of grains to be sorted from each other is supplied from the supply duct assembly 171 and the ducts 182 and 183 of the grain distributing assembly 179 through the cut-away portions 66 in the end walls 63 of the respective sorting plate members 53 of the stacks 51 and 52 onto the roughened upper surfaces of the respective sorting plate members 53, thereby allowing the mixture to flow toward the lower ends 59 of the respective sorting plate members 53.

A vibratory motion applied to the assembly to be vibrated 80 by the vibrating device 190 causes the stream P of the first kind of grain, the stream R of the second kind of grain having a specific gravity lower than that of the first kind of grain and the stream Q of mixture of the first and second kinds of grain, to be formed separately from each other, while the mixture supplied from each of the ducts 182 and 183 of the grain distributing assembly 179 is flowing toward the lower ends 59 of the respective sorting plate members 53.

The stream P of the first kind of grain, the stream R of the second kind of grain and the stream Q of mixture sorted from each other descend from the lower ends 59 of the respective sorting plate members 53 into the collecting assembly 220, whereupon the first partition member 256 parts the stream P of the first kind of grain from the stream Q of mixture and the second separating member 257 parts the stream R of the second kind of grain from the stream Q of mixture. The thus sorted first and second kinds of grain are discharged from the discharge ports 231 and 232; and 234 and 236, respectively and the mixture is discharged from the discharge ports 237 and 238, respectively. If desired, the mixture may be returned back to the supply duct assembly 170 by a suitable delivery means (not shown).

Figure 6:
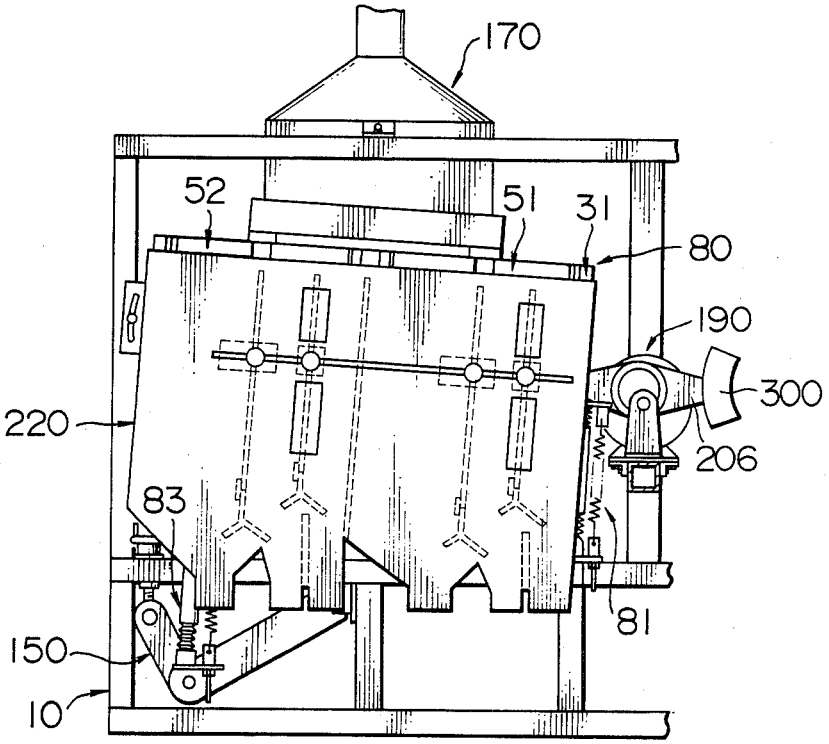
FIG. 6 is a partially broken-away, front elevational view of a grain sorting machine in accordance with another embodiment of the invention.

FIG. 6 shows a vibratory grain sorting machine in accordance with another embodiment of the present invention. The embodiment shown in FIG. 6 is substantially the same as the embodiment shown in FIGS. 1 through 5, except that a counterweight 300 is fixedly connected to the free end of the connecting rod 206 of the vibrating device 190, in lieu of the right side assembly to be vibrated 80*a*. In FIG. 6, the like typical components as those shown in FIGS. 1 to 5 are designated by the like reference characters. The explanations for such like components have been omitted in order to avoid the duplication.

The preferred embodiments of th invention have been described above, but it is apparent that various changes and modifications to the present invention are possible without the departure of the scope and spirit of the appended claims. For example, the frame 31 does not need to have fixedly mounted thereon a pair of stacks of sorting plate members 51 and 52, but may have fixedly mounted thereon only a single stack of sorting plate members. In this case, the channel members 46 and 47; and 48 and 49 are unnecessary. Also, the frame 31 does not necessarily need a pair of spaced U-shaped channel members 32 and 33, but may comprise a single U-shaped member having a greater width. Further, it is not always necessary that the sorting plate members 53 are fixedly mounted on the frame 31 by bolts or screws, and a plurality of sorting plate members may be stacked one above the other with each pair of adjacent sorting plate members being fixedly connected to each other, to form a stack of sorting plate members. In this case, it is sufficient to simply set or press the stack of sorting plate members on or against the bottom of the U-shaped frame 31 by clamp means respectively associated with the top ends of the respective legs of the U-shaped frame 31. Furthermore, the top ends of the respective legs of the U-shaped frame 31 may be bridged or covered to prevent dust or foreign matter from being deposited on the respective top sorting plate members 53.

In addition, the strut units should not be limited to those shown in the drawings. Each strut unit may comprise an upper ball or roller bearing fixed to the frame, a lower ball or roller bearing fixed to the base structure, an upper pin rotatably supported by the upper bearing, a lower pin rotatably supported by the lower bearing, and a hollow or solid rod having an upper end thereof fixedly connected to the upper pin and a lower end fixed to the lower pin.

Furthermore, it is not necessarily required to provide a pair of inward strut units 81 and 82, but instead, it may be sufficient to provide only one inward strut unit. In this case, the only one strut unit has a top end thereof pivotally connected to that area of the horizontal channel member 42 of the frame 31 which is located below the bracket 209 secured to the horizontal channel member 42.

The vibratory sorting machine according to the present invention is arranged such that at least one strut unit 81 and/or 82 has a top thereof pivotally connected to the side wall (legs 34 and 37 of the respective U-shaped channel members 32 and 33 and horizontal channel member 42) of the frame 31, at a location between upper and lower ends of the side wall. Such arrangement enables the minimum height of the assembly to be vibrated 80, with respect to the base structure 10, to be determined, unlike the prior art mentioned before, by lengths of the strut units 83 and 84 having their respective top ends pivotally connected respectively to those areas of the bottom wall (bottoms 39 and 41 of the respective channel members 32 and 33) of the frame 31, which are located adjacent to the higher side edge of the bottom wall. This make it possible to reduce the height of the assembly to be vibrated 80, with respect to the base structure 10, thereby enhancing the stability of the overall sorting machine. In addition, the vibrating device 190 is arranged such that it applies a force to the assembly to be vibrated 80, substantially toward and away from the ravitational center thereof to cause the assembly to be vibrated 80 to be angularly reciprocated around the bottom ends of the respective strut units 81 and/or 82; and 83 and 84. Such arrangements enables the assembly to be vibrated with substantially no rotational moment resulting around the center of gravitY of the assembly so vibrated. This acts to minimize impact forces on the pivotal connections between the frame 31 and the top ends of the respective strut units and the pivotal connections between the base structure 10 and the bottom ends of the respective strut units, thereby enhancing the service life of the strut units.

In accordance with the preferred embodiments of the invention, the vibrating device 190 is located at a horizontal level substantially corresponding to the center of gravity of the assembly to be vibrated 80. In other words, the vibrating device 190 is located at a position considerably above the base structure 10. This makes the vibrating device 190 readily accessible to the operator for the purpose of maintenance and inspection.

Further, in accordance with the preferred embodiments of the invention, the strut units 81, 82, 83 and 84 are substantially identical in structure with each other. This facilitates the assembly work of the sorting machine and reduces the cost of the sorting machine.

What I claim is:

1. A vibratory grain sorting machine comprising:

a frame having opposed side walls and a bottom wall extending therebetween;

one stack of sorting plate members each of which has a roughened upper surface, said stack of sorting plate members being fixedly mounted on said frame so that the roughened upper surfaces of the respective sorting plate members are spaced from each other, each of said sorting plate members being inclined in a three-dimensional manner with respect to a horizontal plane so as to have an upper side edge, a lower side edge, an upper end and a lower end for discharging grain, the respective upper side edges extending along one of said side walls of said frame and the respective lower side edges extending along the other side wall of said frame;

a base structure;

a plurality of strut units supporting, on said base structure, an assembly to be vibrated at least including said frame and said stack of sorting plate members fixedly mounted thereon so that said assembly to be vibrated is movable relative to said base structure and that a first intersecting line between said bottom wall and said one side wall of said frame is located above a second intersecting line between said bottom wall and said the other side wall of said frame, at least one of said strut units having a top end pivotally connected to said other side wall of said frame at a location between upper and lower ends of said other wall and a bottom end pivotally connected to said base structure, each of the remaining strut units having a top end pivotally connected to an area, adjacent to said first intersecting line, of said bottom wall of said frame and a bottom end pivotally connected to said base structure;

supply means for supplying a mixture of a first kind of grain and a second kind of grain having a specific gravity different from that of said first kind of grain, onto the roughened upper surfaces of the respective sorting plate members at the upper ends of the respective sorting plate members, to allow said mixture to flow toward the lower ends of the respective sorting plate members;

vibrating means fixedly mounted relative to said base structure and connected to said frame for applying a force to said assembly to be vibrated, substantially toward and away from a center of gravity thereof so as not to produce substantial rotational moment around such center of gravity, to angularly reciprocate the assembly to be vibrated around the bottom ends of the respective strut units, to thereby enable a stream of the first kind of grain, a stream of the second kind of grain and a stream of mixture of the first and second kinds of grain to be separately formed on the roughened upper surface of each of said sorting plate members, while the supplied mixture is flowing toward the lower ends of the respective sorting plate members; and collecting means for separately collecting the stream of the first kind of grain, the stream of the second kind of grain and the stream of the mixture from the lower end of each of said sorting plate members.

2. A vibratory grain sorting machine as set forth in claim 1, wherein the top end of said at least one strut unit is connected to that area of said other side wall of said frame, which is located substantially centrally in the heightwise direction of said other side wall.

3. A vibratory grain sorting machine as set forth in claim 2, wherein said at least one strut unit comprises one strut unit having a top end connected to said center area of said other side wall of said frame, adjacent to said upper ends of the respective sorting plate members and a bottom end connected to said base structure, and another strut unit having a top end connected to said center area of said other side wall of said frame, adjacent to the lower ends of the respective sorting plate members and a bottom end connected to said base structure.

4. A vibratory grain sorting machine as set forth in claim 3, wherein said one and another strut units and the remaining strut units have substantially the same length, the bottom ends of the respective one and another strut units being located at an upper level of said base structure and the bottom ends of the remaining strut units being located at a lower level of said base structure.

5. A vibratory grain sorting machine as set forth in claim 4, wherein said vibrating means is connected to said other side wall of said frame at a horizontal level substantially corresponding to the center of gravity of said assembly to be vibrated.

6. A vibratory grain sorting machine as set forth in claim 1, wherein said vibrating means includes a motor having an output shaft, an eccentric wheel mounted on said output shaft for rotation therewith, a ring mounted on said eccentric wheel so as to be rotatable relative thereto, and a connecting rod extending from said ring for connecting said ring to said other side wall of said frame.

7. A vibratory grain sorting machine as set forth in claim 6, wherein said vibrating means further comprises a second connecting rod extending from said ring in the opposite direction with respect to the first-mentioned connecting rod, said second connecting rod having connected to a free end thereof a counterweight.

8. A vibratory grain sorting machine as set forth in claim 7, wherein each of all of said strut units comprises an upper bracket fixedly connected to said frame, a lower bracket fixedly connected to said base structure, an upper projection having a rounded free end and extending from said upper bracket toward said lower bracket, an elongated strut body provided at its top end with a groove for pivotally receiving said rounded free end of said upper projection, said strut body having a bottom end thereof provided with a lower projection having a rounded free end and extending toward said lower bracket, said lower bracket being provided with a groove for pivotally receiving said rounded free end of said lower projection, and spring menas having an upper end attached to said upper bracket and a lower end attached to said lower bracket for biasing said upper and lower brackets toward each other.

9. A vibratory grain sorting machine as set forth in claim 6, wherein each of all of said strut units comprises an upper bracket fixedly connected to said frame, a lower bracket fixedly connected to said base structure, an upper projection having a rounded free end and extending from said upper bracket toward said lower bracket, an elongated strut body provided at its top end with a groove for pivotally receiving said rounded free end of said upper projection, said strut body having a bottom end thereof provided with a lower projection having a rounded free end and extending toward said lower bracket, said lower bracket being provided with a groove for pivotally receiving said rounded free end of said lower projection, and spring means having an upper end attached to said upper bracket and a lower end attached to said lower bracket for biasing said upper and lower brackets toward each other.

10. A vibratory grain sorting machine as set forth in claim 1, further comprising:

a second frame having opposed side walls and a bottom wall extending therebetween;

one second stack of sorting plate members each having a roughened upper surface, said second stack of sorting plate members being fixedly mounted on said second frame so that the roughened upper surface of the respective sorting plate members of said second stack are spaced from each other, each of said sorting plate members of said second stack being inclined in a three-dimensional manner with respect to a horizontal plane so as to have an upper side edge, a lower side edge, an upper end and a lower end for discharging grain, said upper side edges of the sorting plate members of said second stack extending along one of said side walls of said second frame and said lower side edges of the sorting plate members of said second stack extending along the other side wall of said second frame;

a second assembly to be vibrated at least including said second frame and said sorting plate members fixedly mounted thereon being juxtaposed with the first-mentioned assembly to be vibrated so that said other side wall of said second frame is arranged in spaced and facing relation with said other side wall of the first-mentioned frame;

a plurality of second strut units supporting, on said base structure, said second assembly to be vibrated such that said second assembly to be vibrated is movable relative to said base structure and that a third intersecting line between said bottom wall and said one side wall of said second frame is located above a fourth intersecting line between said bottom wall and said other side wall of said second frame, at least one of said second strut units having a top end pivotally connected to said other side wall of said second frame at a location between upper and lower ends of said other side wall of said second frame and a bottom end pivotally connected to said base structure, and each of the remaining second strut units having a top end pivotally connected to an area, adjacent to said third intersecting line, of said bottom wall of said second frame and a bottom end pivotally connected to said base structure;

second supply means for supplying a second mixture of a third kind of grain and a fourth kind of grain having a specific gravity different from that of said third kind of grain, onto a roughened upper surface of each of said sorting plate members mounted on said second frame, at said upper end of the respective sorting plate members mounted on said second frame, thereby allowing said second mixture to flow toward the lower end of each of said sorting plate members mounted on said second frame;

said vibrating means applying a force to said second assembly to be vibrated, substantially toward and away from a center of gravity thereof to angularly reciprocate said second assembly to be vibrated, around the bottom ends of the respective second strut units, to thereby enable a stream of the third kind of qrain, a stream of the fourth kind of grain and a stream of the second mixture of the third and fourth kinds of grain to be separately formed on the roughened upper surface of each of said sorting plate members mounted on said second frame, while the supplied second mixture is flowing toward the lower end of the respective sorting plate members mounted on said second frame; and second collecting means for separately collecting said stream of the third kind of grain, said stream of the fourth kind of grain and said stream of the second mixture from the lower end of each of said sorting plate members mounted on said second frame.

11. A vibratory grain sorting machine as set forth in claim 10, wherein the top end of said at least one second strut unit is connected to an area of said other side wall of said second frame, which is located substantially centrally in the heightwise direction of said other side wall of said second frame.

12. A vibratory grain sorting machine as set forth in claim 11, wherein said at least one second strut unit comprises one second strut unit having a top end connected to said center area of said other side wall of said second frame, adjacent to said upper end of the respective sorting plate members mounted on said second frame and a bottom end connected to said base structure and another second strut unit-having a top end connected to said center area of said other side wall of said second frame, adjacent to the lower end of the respective sorting plate members mounted on said second frame and a bottom end connected to said base structure.

13. A vibratory grain sorting machine as set forth in claim 13, wherein said one and another second strut units and the remaining second strut units have substantially the same length, the bottom ends of the one and another second strut units being located at an upper level of said base structure and the bottom ends of the remaining respective second strut units being located at a lower level of said base structure.

14. A vibratory grain sorting machine as set forth in claim 13, wherein said vibrating means is connected to said other side wall of said second frame at a horizontal level substantially corresponding to the center of gravity of said second assembly to be vibrated.

15. A vibratory grain sorting machine as defined in claim 10, wherein said vibrating means is connected to said other side walls of the respective first and second frames.

16. A vibratory grain sorting machine as defined in claim 1, wherein said vibrating means is connected to said other side wall of said frame.

17. A vibratory grain sorting machine comprising:

a frame having opposed side walls and a bottom wall extending therebetween;

two stacks of vertically spaced sorting plate members each of which has a roughened upper surface, said stacks of sorting plate members being fixedly mounted on said frame in juxtaposed relation but spaced from each other, each of said sorting plate members being inclined in a three-dimensional manner with respect to a horizontal plane so as to have an upper side edge, a lower side edge, an upper end and a lower end for discharging grain, the respective upper side edges of said sorting plate members in one of said stacks extending along one of said side walls of said frame and the respective lower side edges of said sorting plate members in the other of said stacks extending along the other side wall of said frame, said frame further comprising a third side wall disposed between said two stacks of sorting plate members;

a base structure;

a plurality of strut units supporting, on said base structure, an assembly to be vibrated at least including said frame and said two stacks of sorting plate members fixedly mounted thereon so that said assembly to be vibrated is movable relative to said base structure and that a first intersecting line between said bottom wall and said one side wall of said framee is located above a second intersecting line between said bottom wall and said other side wall of said frame, at least one of said strut units having a top end pivotally connected to said other side wall of said frame at a substantially central heightwise area of said other side wall in a region thereof adjacent to said upper end of the respective sorting plate members and a bottom end pivotally connected to said base structure, and another strut unit having a top end connected to said substantially central heightwise area of said other side wall of said frame, in a region thereof adjacent to the lower end of the respective sorting plate members, and a bottom end connected to said base structure, each of the remaining strut units having a top end pivotally connected to an area, adjacent to said first intersecting line, of said bottom wall of said frame and a bottom end pivotally connected to said base structure, each said strut units being of substantially equal length, with the bottom ends of the at least one and another strut units being located at an upper level of said base structure and the bottom ends of the remaining strut units being located at a lower level of said base structure;

supply means for supplying a mixture of a first kind of grain and a second kind of grain having a specific gravity different from that of said first kind of grain, onto the roughened upper surface of the respective sorting plate members at the upper end of the respective sorting plate members, to allow said mixture to flow toward the lower end of the respective sorting plate members;

vibrating means fixedly mounted relative to said base structure and connected to said other side wall of said frame at a horizontal level substantially corresponding to the center of gravity of said assembly to be vibrated, for applying a force to said assembly to be vibrated, substantially toward and away from said center of gravity thereof, to anularly reciprocate the assembly to be vibrated around the bottom ends of the respective strut units, to thereby enable a stream of the first kind of grain, a stream of the second kind of grain and a stream of the mixture of the first and second kinds of grain to be separately formed on the roughened upper surface of each of said sorting plate members, while the supplied mixture is flowing toward the lower end of the respective sorting plate members; and collecting means for separately collecting the stream of the first kind of grain, the stream of the second kind of grain and the stream of the mixture from the lower end of each of said sorting plate members.

18. A vibratory grain sorting machine as set forth in claim 17, further comprising adjusting means mounted on said base structure and connected to the respective bottom ends of said remaining strut units for moving said remaining strut units relative to said base structure, to thereby adjust an inclination of said stacks of sorting plate members.

19. A vibratory grain sorting machine as set forth in claim 18, wherein said adjusting means comprises link means having one end thereof connected to the respective bottom ends of the remaining strut units and a second end pivotally connected to said base structure, and actuator means mounted on said base structure and pivotally connected to said link means to cause said link means to be pivoted around said second end thereof.

20. A vibratory grain sorting machine comprising:

a frame having opposed side walls and a bottom wall extending therebetween;

one stack of sorting plate members each of which has a roughened upper surface, said stack of sorting plate members being fixedly mounted on said frame so that the roughened upper surfaces of the respective sorting plate members are spaced from each other, each of said sorting plate members being inclined in a three-dimensional manner with respect to a horizontal plane so as to have an upper side edge, a lower side edge, an upper end and a lower end for discharging grain, the respective upper side edges extending along one of said side walls of said frame and the respective lower side edges extending along the other side wall of said frame;

a base structure;

a plurality of strut units supporting, on said base structure, an assembly to be vibrated at least including said frame and said stack of sorting plate members fixedly mounted thereon so that said assembly to be vibrated is movable relative to said base structure and that a first intersecting line between said bottom wall and said one side wall of said frame is located above a second intersecting linebetween said bottom wall and said other side wall of said frame, at least one of said strut units having a top end pivotally connected to said other side wall of said frame at a location between upper and lower ends of said other side wall and a bottom end pivotally connected to said base structure, each of the remaining strut units having a top end pivotally connected to an area, adjacent to said first intersecting line, of said bottom wall of said frame and a bottom end pivotally connected to said base structure, each of said strut units comprising an upper bracket fixedly connected to said frame, a lower bracket fixedly connected to said base structure, an upper projection having a rounded free end and extending from said upper bracket toward said lower bracket, an elongated strut body provided at its top end with a groove for pivotally receiving said rounded free end of said upper projection, said strut body having a bottom end thereof provided with a lower projection having a rounded free end and extending toward said lower bracket, said lower bracket being provided with a groove for pivotally receiving said rounded free end of said lower projection, and spring means having an upper end attached to said upper bracket and a lower end attached to said lower bracket for biasing said upper and lower brackets toward each other, supply means for supply a mixture of a first kind of grain and a second kind of grain having a specific gravity different from that of said first kind of grain, onto the roughened upper surfaces of the respective sorting plate members at the upper end of the respective sorting plate members, to allow said mixture to flow toward the lower end of the respective sorting plate members;

vibrating means fixedly mounted relative to said base structure and connected to said frame for applying a force to said assembly to be vibrated, substantially toward and away from the center of gravity thereof, to angularly reciprocate the assembly to be vibrated around the bottom ends of the respective struts units, to thereby enable a stream of the first kind of grain, a stream of the second kind of grain and a stream of the mixture of the first and second kinds of grain to be separately formed on the roughened upper surface of each of said sorting plate members, while the supplied mixture is flowing toward the lower end of the respective sorting plate membes, said vibrating means includes a motor having an output shaft, an eccentric wheel mounted on said output shaft for rotation therewith, a ring mounted on said eccentric wheel so as to be rotatable relative thereto, a connecting rod extending from said ring for connecting said ring to said other side wall of said frame, and collecting means for separately collecting the stream of the first kind of grain, the stream of the second kind of grain and the stream of the mixture from the lower end of each of said sorting plate members, said collecting means comprising a tubular body pivotally mounted on said base structure and having an opening for receiving the lower end of the respective sorting plate members, means for fixing said tubular body relative to said base structure at a desired angular position, and partition plate means disposed within said tubular body and mounted thereon so as to be movable along the lower end of the respective sorting plate members for parting said stream of the first kind of grain, said stream of the second kind of grain and said stream of the mixture out of the lower end of the respective sorting plate members, from each other.

21. A vibratory grain sorting machine as set forth in claim 20, wherein said supply means comprises a supply duct assembly fixed relative to said base structure and a drain distributing duct assembly fixed to the upper end of the respective sorting plate members in communication with said supply duct assembly for supplying each of said sorting plate members with the mixture, said assembly to be vibrated further including said grain distributing duct assembly.

22. A vibratory grain sorting machine comprising:

a first frame having opposed side walls and a bottom wall extending therebetween;

one stack of sorting plate members each of which has a roughened upper surface, said stack of sorting plate members being fixedly mounted on said frame so that the roughened upper surfaces of the respective sorting plate members are spaced from each other, each of said sorting plate members being inclined in a three-dimensional manner with respect to a horizontal plane so as to have an upper side edge, a lower side edge, an upper end and a lower end for discharging grain, the respective upper side edges extending along one of said side walls of said frame and the respective lower side edges extending along the other side wall of said frame;

a base structure;

a plurality of strut units supporting, on said base structure, an assembly to be vibrated at least including said frame and said one stack of sorting plate members fixedly mounted thereon so that said assembly to be vibrated is movable relative to said base structure and that a first intersecting line between said bottom wall and said one side wall of said frame is located above a second intersecting line between said bottom wall and said other side wall of said frame, at least one of said strut units having a top end pivotally connected to said other side wall of said frame at a location between upper and lower ends of said other side wall and a bottom end pivotally connected to said base structure, each of the remaining strut units having a top end pivotally connected to an area, adjacent to said first intersecting line, of aid bottom wall of said frame and a bottom end pivotally connected to aid base structure supply means for supplying a mixture of a first kind of grain and a second kind of grain having a specific gravity different from that of said first kind of grain, onto the roughened upper surfaces of the respective sorting plate members at the upper end of the respective sorting plate members, to allow said mixture to flow toward the lower end of the respective sorting plate members;

vibrating means fixedly mounted relative to said base structure and connected to said frame for applying a force to said assembly to be vibrated, substantially toward and away from the center of gravity thereof, to angularly reciprocate the assembly to be vibrated around the bottom end of the respective strut units, to thereby enable a stream of the first kind of grain, a stream of the second kind of grain and a steam of the mixture of the first and second kinds of grain to be separately formed on the roughened upper surface of each of said sorting plate members, while the supplied mixture is flowing toward the lower end of the respective sorting plate members, collecting means for separately collecting the stream of the first kind of grain, the stream of the second kind of grain and the stream of the mixture from the lower end of each of said sorting plate members, a second frame having opposed side walls and a bottom wall extending therebetween;

one second stack of vertically spaced sorting plate members each having a roughened upper surface, said second stack of sorting plate members being fixedly mounted on aid second frame in spaced relation with said first frame, each of said sorting plate members of said second stack being inclined in a three-dimensional manner with respect to a horizontal plane so as to have an upper side edge, a lower side edge, an upper end and a lower end for discharging grain, said upper side edges of the sorting plate members of said second stack extending along one of said side walls of said second frame and said lower side edges of the sorting plate members of said second stack extending along the other side wall of said second frame;

a second assembly to be vibrated at least including said second frame and said sorting plate members fixedly mounted thereon being juxtaposed with the first-mentioned assembly to be vibrated so that said other side wall of said second frame is spaced and facing relation with said other side wall of the first-mentioned frame;

a plurality of second strut units supporting, on said base structure, said second assembly to be vibrated such that said second assembly to be vibrated is movable relative to said base structure and that a third intersecting line between said bottom wall and said one side wall of said second frame is located above a fourth intersecting line between said bottom wall and said other side wall of said second frame, at least one of said second strut units having a top end pivotally connected to an area of said other side wall of said second frame which is located substantially centrally in the heightwise direction of said other side wall of said second frame adjacent to said upper end of the respective sorting plate members mounted on said second frame, and a bottom end pivotally connected to said base structure, and each of the remaining second strut units having a top end pivotally connected to an area, adjacent to said third intersecting line, of said bottom wall of said second frame and a bottom end pivotally connected to said base structure, said at least one second strut unit and the remaining second strut units having substantially the same length, the bottom ends of the at least one second strut unit being located at an upper level of said base structure and the bottom end of the remaining second strut units being located at a lower level of said base structure;

second supply means for supplying a second mixture of a third kind of grain and a fourth kind of grain having a specific gravity different from that of said third kind of grain, onto a roughened upper surface of each of said sorting plate members mounted on said second frame, at said upper end of the respective sorting plate members mounted on said second frame, thereby allowing said second mixture to flow toward the lower end of each of said sorting plate members mounted on said second frame;

vibrating means connected to said other side wall of said second frame at a horizontal level substantially corresponding to the center of gravity of said second assembly to be vibrated for applying a force to said second assembly to be vibrated, substantially toward and away from the center of gravity thereof to angularly reciprocate said second assembly to be vibrated, around the bottom ends of the respective second strut units, to thereby enable a stream of the third kind of grain, a stream of the fourth kind of grain and a stream of the second mixture of the third and fourth kinds of grain to be separately formed on the roughened upper surface of each of said sorting plate members mounted on said second frame, while the supplied second mixture is flowing toward the lower end of the respective sorting plate members mounted on said second frame; and second collecting means for separately collecting said stream of the third kind of grain, said stream of the fourth kind of grain and said stream of the second mixture from the lower end of each of said sorting plate members mounted on said second frame.

23. A vibratory grain sorting machine as set forth in claim 22, further comprising adjusting means mounted on said base structure and connected to the bottom end of the remaining strut units for moving the remaining strut units relative to said base structure, thereby adjusting an inclination of said stacks of sorting plate members mounted on said first and second frames.

24. A vibratory grain sorting machine as set forth in claim 23, wherein said adjusting means comprises link means having one end thereof connected to the bottom end of the respective remaining strut units and the other end pivotally connected to said base structure, and actuator means mounted on said base structure and pivotally connected to said link means to cause said link means to be pivoted around said other end thereof.

25. A vibratory grain sorting machine as set forth in claim 24, wherein said vibrating means includes a motor having an output shaft, an eccentric wheel mounted on said output shaft for rotation therewith, a ring mounted on said eccentric wheel so as to be rotatable thereto, and a connecting rod extending from said ring for connecting said ring to said other side wall of said first and second frames.

26. A vibratory grain sorting machine as set forth in claim 25, wherein each of all of said strut units comprises an upper bracket fixedly connected to a respective frame, a lower bracket fixedly connected to said base structure, an upper projection having a rounded free end and extending from said upper bracket toward said lower bracket, an elongated strut body provided at its top end with a groove for pivotally receiving said rounded free end of said upper projection, said strut body having a bottom end thereof provided with a lower projection having a rounded free end and extending toward said lower bracket, said lower bracket being provided with a groove for pivotally receiving said rounded free end of said lower projection, and spring means having an upper end attached to said upper bracket and a lower end attached to said lower bracket for biasing said upper and lower brackets toward each other.

27. A vibratory grain sorting machine as set forth in claim 26, wherein each said collecting means comprises a tubular body pivotally mounted on said base structure and having an opening for receiving said lower end of the respective sorting plate members, means for fixing said tubular body relative to said base structure at a desired angular position, and partition plate means disposed within said tubular body and mounted thereon so as to be movable along said lower end of the respective sorting plate members for parting said streams of grains from each other.

28. A vibratory grain sorting machine as set forth in claim 27, wherein each said supply means comprises a supply duct assembly fixed relative to said base structure and a grain distributing duct assembly fixed to said upper end of said sorting plate members in communication with said supply duct assembly for supplying each of said sorting plate members with the respective grain mixture, each said assembly to be vibrated further including a grain distributing duct assembly.

29. A vibratory grain sorting machine as set forth in claim 28, wherein said first and second kinds of grain are the same as said third and fourth kinds of grain, respectively.

30. A vibratory grain sorting machine as set forth in claim 29, wherein each said assembly to be vibrated has substantially equal weight.

* * * * *

UNITED STATES PATENT AND TRADEMARK OFFICE

CERTIFICATE OF CORRECTION

PATENT NO. : 4,722,446

DATED : February 2, 1988

INVENTOR(S) : Toshihiko Satake

It is certified that error appears in the above-identified patent and that said Letters Patent is hereby corrected as shown below:

Column 11, claim 1, line 17, delete "the".

Column 15, claim 17, line 3, delete "framee" and substitute therefor --frame--; line 41, delete "anularly" and substitute therefor --angularly--.

Column 16, line 29, delete "linebetween" and substitute therefor --line between--.

Column 19, claim 22, line 20, delete "end" and substiture therefor --ends--.

Column 18, claim 22, line 10, delete "aid" and substitute therefor --said--; line 44, delete "aid" and substitute therefor --said--.

Signed and Sealed this

Twenty-sixth Day of July, 1988

*Attest:*

DONALD J. QUIGG

*Attesting Officer*

*Commissioner of Patents and Trademarks*